US006105186A

United States Patent [19]

Stone Munson

[11] Patent Number: 6,105,186

[45] **Date of Patent: *Aug. 22, 2000**

[54] MULTILAYER DECORATIVE TRIM STRIP FOR COMFORTERS, QUILTS, AND THE LIKE

[76] Inventor: Lou Ann Elizabeth Stone Munson, 7015 Leebrad St., Springfield, Va. 22151

[ * ] Notice: This patent is subject to a terminal disclaimer.

[21] Appl. No.: 09/289,649

[22] Filed: Apr. 12, 1999

Related U.S. Application Data

[63] Continuation-in-part of application No. 09/191,386, Nov. 13, 1998, which is a continuation-in-part of application No. 08/792,850, Jan. 23, 1997, Pat. No. 5,836,023.

[51] Int. Cl.[7] ..... A47G 9/00

[52] U.S. Cl. ..... 5/482; 5/485; 5/301; 5/502

[58] Field of Search ..... 5/482, 485, 486, 5/493, 498, 501, 502, 907

[56] References Cited

U.S. PATENT DOCUMENTS

| | | | |
|---|---|---|---|
| 708,109 | 9/1902 | Williams | 5/501 |
| 992,101 | 5/1911 | Adams | 5/501 |
| 1,009,332 | 11/1911 | Mead | 5/501 |
| 1,241,968 | 10/1917 | Hansen | 5/501 |
| 1,347,642 | 7/1920 | McNatt . | |
| 1,577,226 | 3/1926 | Greenberg | 5/501 |
| 1,764,764 | 6/1930 | Stewart . | |
| 2,217,819 | 10/1940 | Rook et al. . | |
| 2,262,436 | 11/1941 | Cotton | 5/501 |
| 4,884,305 | 12/1989 | Blackmon . | |
| 4,991,245 | 2/1991 | Franco . | |
| 5,099,530 | 3/1992 | Scott . | |
| 5,836,023 | 11/1998 | Munson | 5/501 |

*Primary Examiner*—Michael F. Trettel
*Attorney, Agent, or Firm*—Lacasse & Associates; Randy W. Lacasse

[57] ABSTRACT

A reversible multilayer decorative trim strip for comforters, quilts, and the like includes one or more decorative non-linearly patterned edges. The trim strip is removably fastened to the underside of the comforter and folded over the comforter's edge so that a decorative portion of the trim strip overlies the top side of the comforter. In a bedding arrangement, the comforter has an edge portion which substantially overlies an edge of the top surface of a bed, and the trim strip substantially completely covers the edge portion of the comforter. In an alternative configuration, the trim strip is connected directly to a top portion of the comforter either permanently or in a removable fashion.

27 Claims, 5 Drawing Sheets

MULTILAYER DECORATIVE TRIM STRIP FOR COMFORTERS, QUILTS, AND THE LIKE

This application is a CIP of pending U.S. application Ser. No. 09/191,386 filed on Nov. 13, 1998 entitled DECORATIVE TRIM STRIP FOR COMFORTERS, QUILTS, AND THE LIKE which is a CIP of U.S. application Ser. No. 08/792,850, filed Jan. 23, 1997, now U.S. Pat. No. 5,836,023.

BACKGROUND OF THE INVENTION

1. Field of the Invention

This invention pertains to the field of bedclothes or bed coverings. More particularly, this invention pertains to the field of reversible multilayer decorative trim which is particularly suited for use with bedclothes or bed coverings such as comforters and quilts. Still more particularly, this invention pertains to the field of detachable and interchangeable decorative trim strips for comforters and quilts.

2. Description of the Related Art

The prior art reveals a variety of decorative or functional attachments which are suitable for use with beds and the like. For example, U.S. Pat. No. 2,139,980 reveals a detachable valance for a bed. U.S. Pat. No. 2,619,658 reveals an adjustable and removable valance for studio couch or bed. U.S. Pat. No. 3,273,176 reveals a detachable extension flap for a blanket. United Kingdom Patent Application GB 2142233 reveals a quilt having a protective sheet attached thereto by press studs. U.S. Pat. No. 4,890,347 reveals a detachable decorative applique piece which is designed to be fastened to a comforter or bedspread. U.S. Pat. No. Des. 319,366 reveals a sheet for a comforter or blanket. U.S. Pat. No. Des. 339,495 reveals a dust ruffle with VELCRO brand fasteners. U.S. Pat. No. 5,118,553 reveals a bed covering made up of two connectable panels having respective complementary fasteners disposed at their overlapping borders. In the '553 patent, it is suggested that the first panel may be fabricated from a blanket underliner material (such as used for a conventional bed sheet), a "blanket material", a cloth material, or a synthetic material. Moreover, the second panel may be fabricated from a blanket underliner material, a "sheet material", or a material which may be more decorative than the first panel. At least the bottom side of the second panel is desirably imprinted, embroidered, or otherwise decorated. It is also suggested that the first and second panels may have equal widths. U.S. Pat. No. 5,240,758 provides for a reversible separate piece skirt attachment. U.S. Pat. No. 5,251,350 provides for a three piece sectional comforter with reversible sections. While the prior art has included many attachments to bedding, it has failed to include a multilayer reversible decorative trim strip as will be described, illustrated, and claimed in the following specification, drawings, and claims.

It is an object of the invention to provide a bed clothing arrangement which is user-configurable to provide a high degree of customization at a reasonable cost.

It is another object of the invention to provide a bed clothing arrangement which provides some protection for the end of a comforter, quilt, or other bed covering that is handled the most.

It is still another aspect of the invention to provide a reversible, multi-layer decorative trim strip which provides some protection for the end of a comforter, quilt, or other bed covering that is handled the most.

It is still another aspect of the invention to provide a reversible, multi-layer decorative trim strip which attaches directly to an edge of a comforter, quilt, or other bed covering that is handled the most.

SUMMARY OF THE INVENTION

In one respect, the invention relates to a bed clothing arrangement including a bed covering, a reversible decorative trim strip made of multiple layers of flexible decorative materials, and fastening means for removably fastening the decorative trim strip to the bed covering. The bed covering comprises a bottom panel adapted to be positioned face down on a bed, a top panel, and filler material disposed between the bottom panel and the top panel. The fastening means comprise complementary fastener structures provided respectively at the bottom panel of the bed covering and on a first portion of the decorative trim strip. In this respect, the decorative trim strip is sized and configured and the fastening means are positioned and arranged in such a manner that, when the decorative trim strip is fastened to the bed covering by the fastening means, a second portion of the decorative trim strip is capable of being extended beyond an edge of the bed covering and manipulated or folded over the edge of the bed covering to thereby overlie a corresponding portion of the top panel of the bed covering.

In another respect, the invention relates to a bedding arrangement including a bed having a top horizontal surface, a bed covering overlying the top surface of the bed, a decorative trim strip made of multiple layers of flexible material, wherein the decorative trim strip has one or more decorative, non-linearly patterned edges which extends in at least a widthwise direction of the decorative trim strip and overly the top surface of the bed, and fastening means for removably fastening the decorative trim strip to the bed covering in such a manner that the decorative trim strip substantially covers or substantially completely covers an edge portion of the bed covering and the decorative, non-linearly patterned edge portion of the decorative trim strip overlies a portion of the top surface of the bed.

In yet another respect, the invention relates to a decorative attachment for an article of bed clothing, comprising a decorative trim strip made of multiple layers of flexible material, wherein the decorative trim strip comprises a first portion and a second portion. In this respect, the first portion of the decorative trim strip comprises fastening means, extending in a widthwise direction on the decorative trim strip, for removably fastening the decorative trim strip to the article of bed clothing, the second portion of the decorative trim strip comprising reversible decorative surfaces and one or more non-linearly patterned edges.

In yet another respect, the invention relates to a decorative attachment for an article of bed clothing, comprising a decorative trim strip made of multiple layers of flexible material, wherein the decorative trim strip comprises only said second portion. In this respect, the first portion of the decorative trim strip comprising the fastening means is omitted and the second portion is connected directly to an upper edge of the bed covering, the second portion of the decorative trim strip comprising reversible decorative surfaces and one or more non-linearly patterned edges.

In yet another respect, the invention relates to a decorative attachment for an article of bed clothing, comprising a decorative trim strip made of multiple layers of flexible material, wherein the decorative trim strip comprises a first portion and a second portion. In this respect, the first portion of the decorative trim strip comprises fastening means, extending in a widthwise direction on the decorative trim strip, for removably fastening the decorative trim strip to the article of bed clothing, the second portion of the decorative trim strip comprising reversible decorative surfaces and one or more non-linearly patterned edges. Added to the first portion, is a moisture barrier which extends along the length of a bottom side of said bed covering.

The invention will, however, be best understood by a review of the following detailed description in conjunction with the accompanying drawings in which:

DESCRIPTION OF THE PREFERRED EMBODIMENTS

Figure 1:
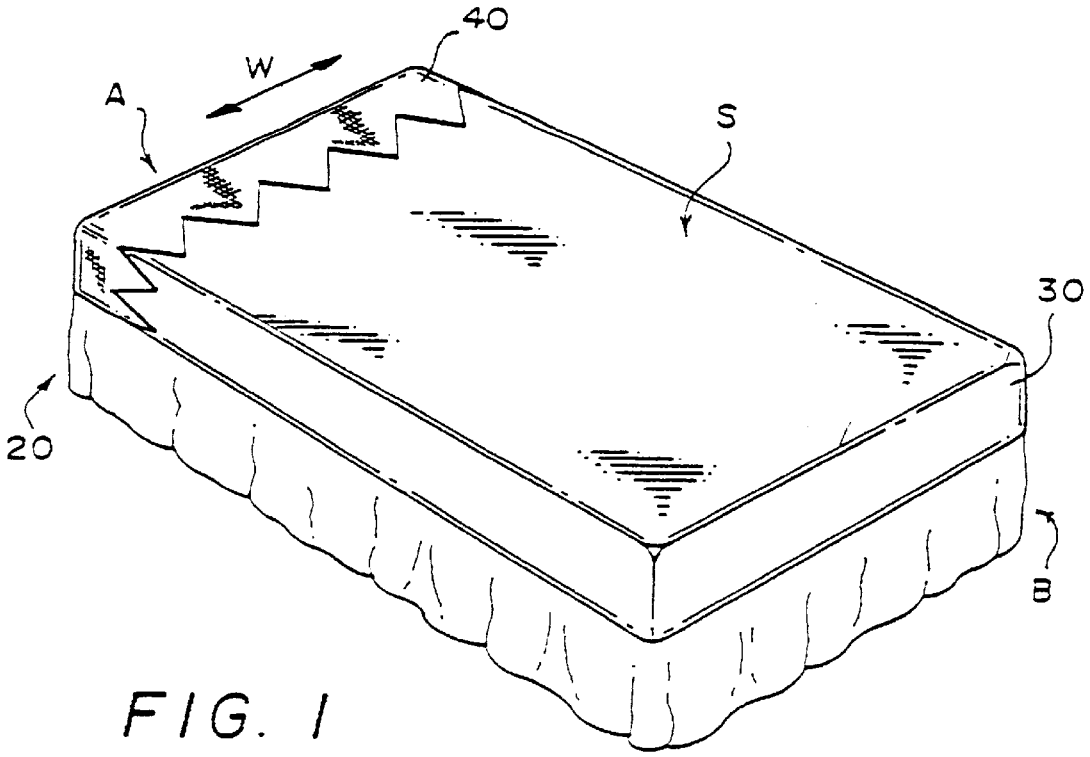
FIG. 1 is a perspective view of a bed having a comforter and decorative trim strip arranged thereon according to a first embodiment of the invention.
Figure 2:
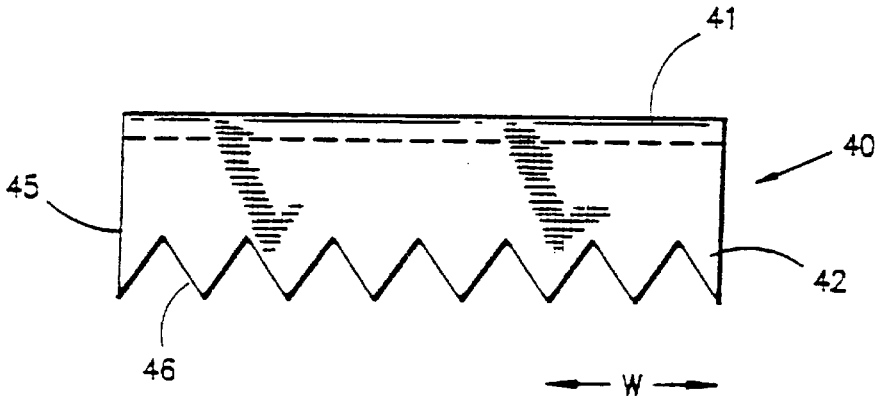
FIG. 2 is a front side view of the decorative trim strip shown in FIG. 1.

Referring now to the drawings in which like reference characters indicate like elements throughout, there is shown in FIGS. 1 and 2 a standard-sized bed 20 on which a comforter 30 (or other bed covering, such as a quilt or blanket) and a decorative trim strip 40 are disposed. The bed 20 in FIG. 1 is, for example, a conventional twin, full, queen, or king-sized bed and comprises a head portion (or pillow end) indicated at A, a foot portion indicated at B, and a top surface indicated at S. The comforter 30 (which may, for example, be a standard-sized comforter having a width and length sized and adapted to fit or cover a twin, full, queen, or king-sized bed) is conventionally positioned so as to overlie the top surface S of the bed 20 and extend partly down the sides and foot of the bed. At the head portion A of the bed 20, the comforter 30 does not extend downwardly beyond the top surface of the bed 20, but (as shown in FIG. 6) a forward most edge portion 30*a* of the comforter 30 is positioned so as to generally or substantially overlie the forward most edge portion 20*a* of the bed 20. The decorative trim strip 40 is removably fastened along the width or alternatively spaced randomly or in a pattern on a first or second section to the comforter 30 by buttons, clasps, Velcro® or other equivalent known attachment methods and is preferably positioned so that the decorative trim strip 40 substantially covers at least that portion 30*a* of the forward most edge of the comforter 30 that overlies the top surface S of the bed 20. The decorative trim strip 40 extends in a widthwise direction W across the comforter 30, and is preferably either substantially or generally the same width as or smaller in width than the comforter 30. (By "generally the same width as", it is meant that the width of the decorative trim strip is within approximately six inches of the width of the comforter 30 or other bed covering.) In the preferred embodiments, the length (i.e. perpendicular to its width) of the decorative trim strip 40 is less than the full length of the comforter 30. (More particularly, the length of the decorative trim strip 40 is preferably less than approximately one-half the full length of the comforter 30.) In the preferred embodiments, the length is preferably selected such that the decorative trim strip 40 overlies or covers, for example, between approximately 10" and 36" (e.g. 18") of the comforter 30 at the head portion A of the bed 20.

Figure 3:
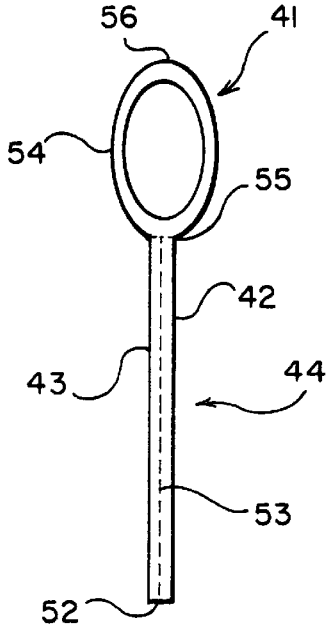
FIG. 3 illustrates a multilayer reversible side view of the decorative trim strip of the preferred embodiment.

FIG. 2 illustrates a front view of the decorative trim strip of the present invention. The decorative trim strip 40 is made from (or comprises) multiple layers of suitable decorative (e.g. patterned or colored) flexible, readily cleanable fabric (such as cotton or silk sheet material, or lace material) and includes a first portion 41 having primarily functional features and characteristics (e.g. used for fastening or attachment) and a second portion 44 having primarily decorative features and characteristics. As shown in FIG. 3 the second portion 44 comprises a first front section 42 and a first mating rear section 43 made of similar or differing materials, including patterned or solid configurations. Sections 42 and 43 are joined along their sides at stitching line 53 and at a bottom end 52. Loop 54 comprises sections 42 and 43 not sewn together along stitching line 53. The loop includes a stitching line across the width W at both the bottom 55 and top ends 56 of loop 54 and is arranged and configured so as to function as a rod pocket or sleeve in a manner previously described in U.S. Pat. No. 5,836,023. The fabric loop, thus made from the two fabric layers, extends the entire width (as indicated at W) of the first portion 41 of the decorative trim strip 40. In an alternate embodiment, stitching line 55 is omitted.

In the case where a light filling of batting material (not shown) is additionally disposed between the two fabric layers 42 and 43, below the stitching line 55, then the fabric layers in one embodiment are sewn or fastened together at other locations (i.e. at several positions disposed inwardly from the edges) to provide layer 42 of the decorative trim strip 40 with a quilted characteristic.

Figure 4A:
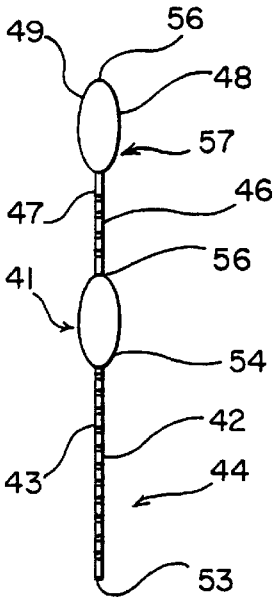
FIGS. 4*a*–4*e* illustrate multiple loop variations of the preferred embodiment.

Illustrated in FIGS. 4*a*–4*e* are alternative embodiments with multiple loops in variable configurations and spacings. FIG. 4*a* adds a section above loop 54 comprising front layer 46 and mating rear layer 47. Sections 46 and 47 may match sections 42 and 43, respectively, in style and composition or be made of different materials and/or patterns, or comprised of a single layer. Above layer(s) 46, 47, loop 57 has been added comprising layers 48 and 49. Loop 57 is constructed in and functions in a similar manner to the above described loop construction/function of loop 54. Either loop 54, loop 57 or both are used to secure the strip 40 to the comforter 30 as previously described in U.S. Pat. No. 5,836,023. If loop 57 is used to secure to the underside of comforter 30, loop 54 can, in one embodiment, be visible on the top surface S side of the comforter thereby affording multiple pattern and height variances.

Figure 4B:
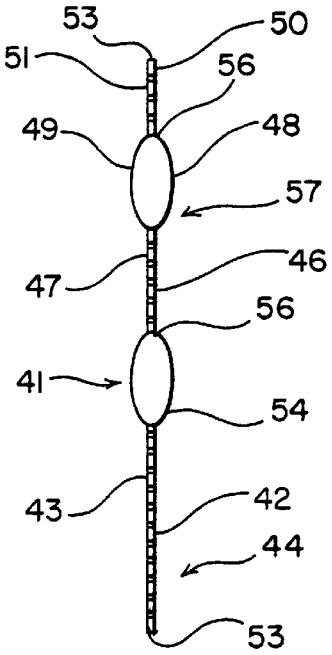
Figure 4D:
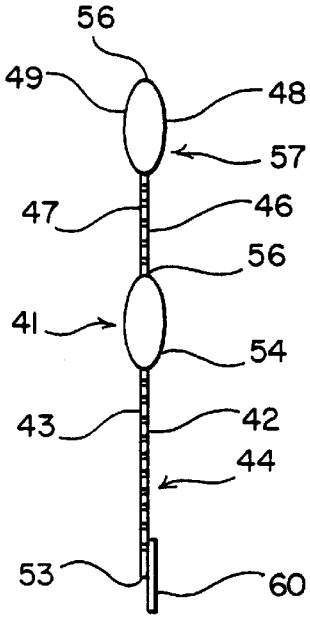
Figure 4C:
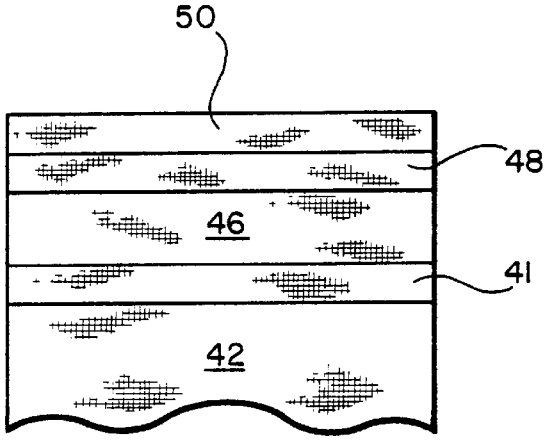

FIGS. 4*b* and 4*c* illustrate a side and top view of a modified FIG. 4*a*. To the structure of 4*a* is added a header section comprising front layer 50 and mating layer 51. The header layer is constructed and functions in a similar manner to that of the mid-section 46,47. Section 42 is visible from the top surface S. Section 41 is, in an alternative embodiment, also visible when folded over the top of comforter 30. In a curtain configuration (fully described in U.S. Pat. No. 5,836,023), the header 50/51 is ruffled, textured, pleated or otherwise patterned.

Figure 5A:
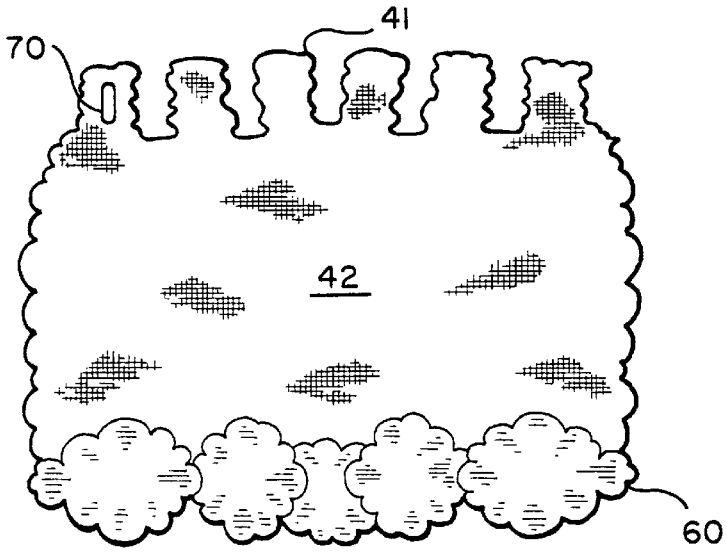
FIGS. 5*a* and 5*b* illustrate applique variations of the present invention.
Figure 5B:
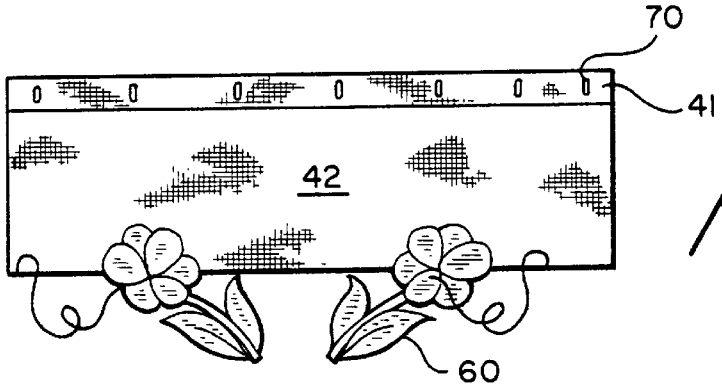

FIG. 4*d* illustrates the addition of one or more decorative applique(s) 60 to section 42. The applique(s) is permanently sewn proximally to the end of section 42. In alternative embodiments, one or more applique(s) are removably attached by known fastening methods. FIGS. 5*a* and 5*b* illustrate typical appliques 60. In FIG. 5*a*, applique 60 is a continuous strip of overlapping clouds sewn along the bottom of section 42. In FIG. 5*b* two separate flower appliques are attached proximate to the bottom of section 42. The present invention is not limited to the number, shape, material composition, or specific location or method of attachment of the applique(s). In addition, in all described embodiments, one, two, three or four edges (FIG. 5*a*) may be decorative in nature. Button holes 70 or other suitable fasteners, as previously described herein and co-pending U.S. Pat. No. 5,836,023, are used to attach the decorative strip to the comforter 30.

Figure 4E:
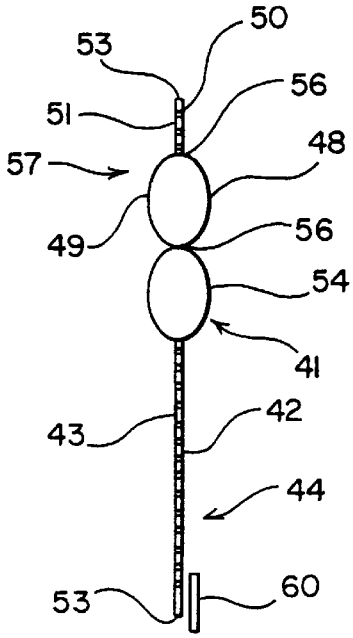

In FIG. 4*e*, loops 54 and 57 are joined together without the intervening mid-sections 46,47. This configuration is modified, in alternative embodiments, to include previously described header section 50, 51 and/or applique(s) 60.

Figure 6A:
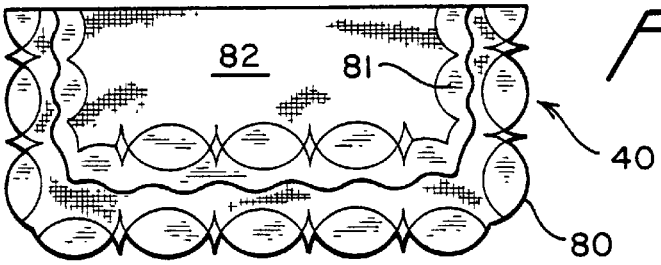
FIGS. 6*a* and 6*b* illustrate multiple separate layer embodiments of the present invention.
Figure 6B:
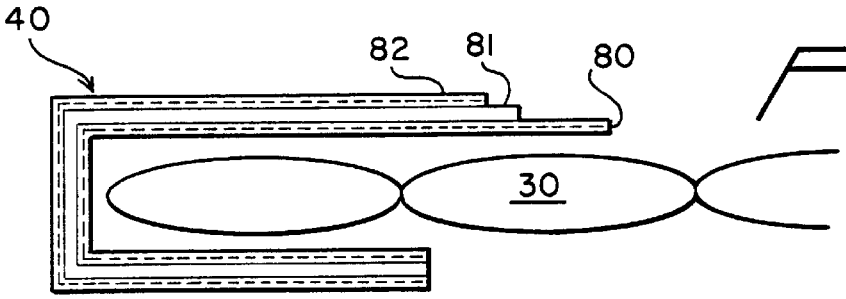

FIGS. 6*a* and 6*b* illustrate a top and side view of an alternative multiple separate layer embodiment. Decorative strip 40 includes separate layers 80, 81 and 82. Each of the layers 80, 81 and 82 comprises one or more sublayers, of similar or differing composition and styles, and is constructed in a manner consistent with the description of FIG. 3. FIG. 6*b* is illustrated as omitting the fastening mechanisms of earlier embodiments, but alternately retains the fastening loop 54 (not shown) to enable attachment to the comforter. Layer 81, in a preferred embodiment, comprises a single layer of decorative lace material, but should not be limited thereto. The sublayers, in an alternative embodiment, comprise an additional batting layer there between (not shown).

Figure 7A:
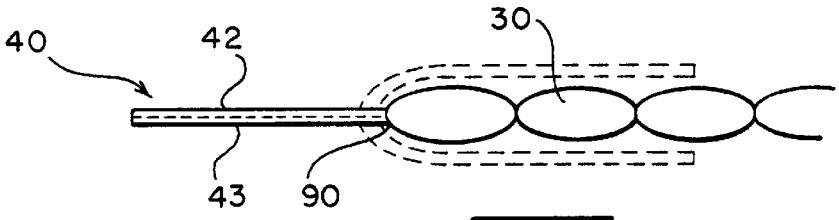
FIGS. 7*a*–7*c* illustrate a permanently connected variation of the present invention.
Figure 7B:
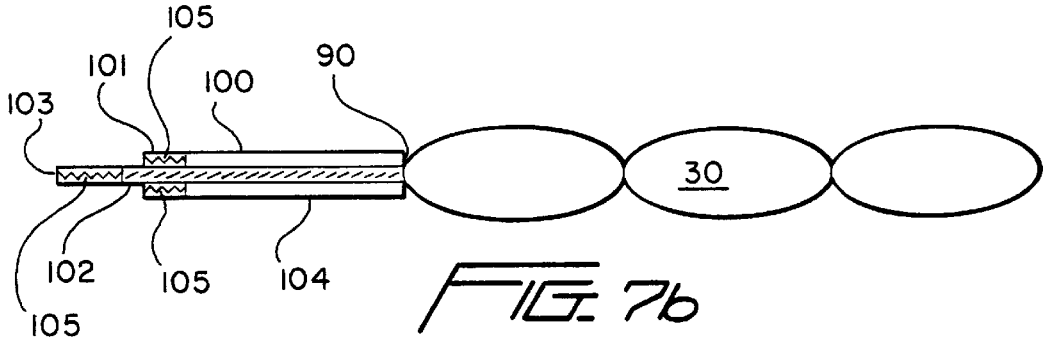
Figure 7C:
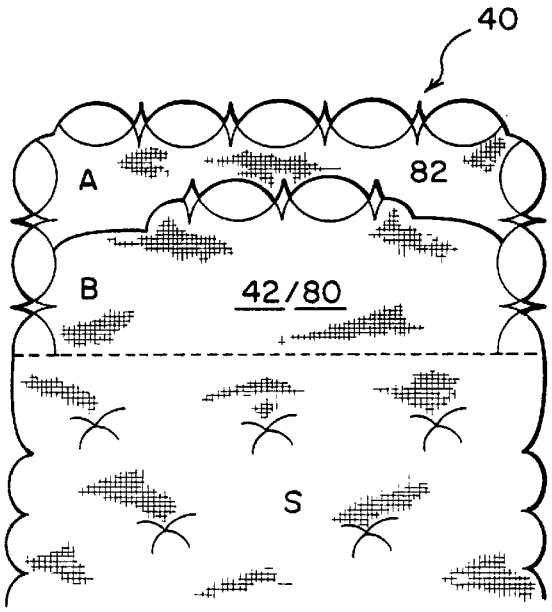

FIGS. 7*a*, 7*b* and 7*c* illustrate variations on an alternative embodiment. In this configuration, the decorative trim strip is sewn proximate to an end of a comforter 30. By sewing the decorative trim strip to the end, the strip can be flipped with the comforter to provide a reversible and aesthetically different design. FIG. 7*a* shows the decorative trim strip 40, comprising layers 42 and 43, constructed as described in the previous embodiments and sewn at 90. The trim strip could equally be removable at this point, using known attachment methods, such as Velcro®, without departing from the scope of the present invention. FIG. 7*b* illustrates a three layer variation similar in composition and construction to that shown in FIG. 6*b*. In the shown figure, layers 100 and 104 are made of single layers of a shorter length than that of layer 102. In addition, each layer adds decorative edges 101, 102 and 103, respectively.

FIG. 7*c* illustrates a top view of decorative trim strip 40 attached to comforter 30 and comprising a plurality of nested layers 80 (equivalent to layer 42) and 82. Three outside decorative edges adorn layer 82, while layer 80 is retained within the boundaries of 82 and comprises a single bottom decorative edge. As with other embodiments, FIGS. 7*a*, 7*b* and 7*c* should not be limited by the specific number of layers, loops, relative size of layers, or the number of sublayers each layer comprises.

Figure 8:
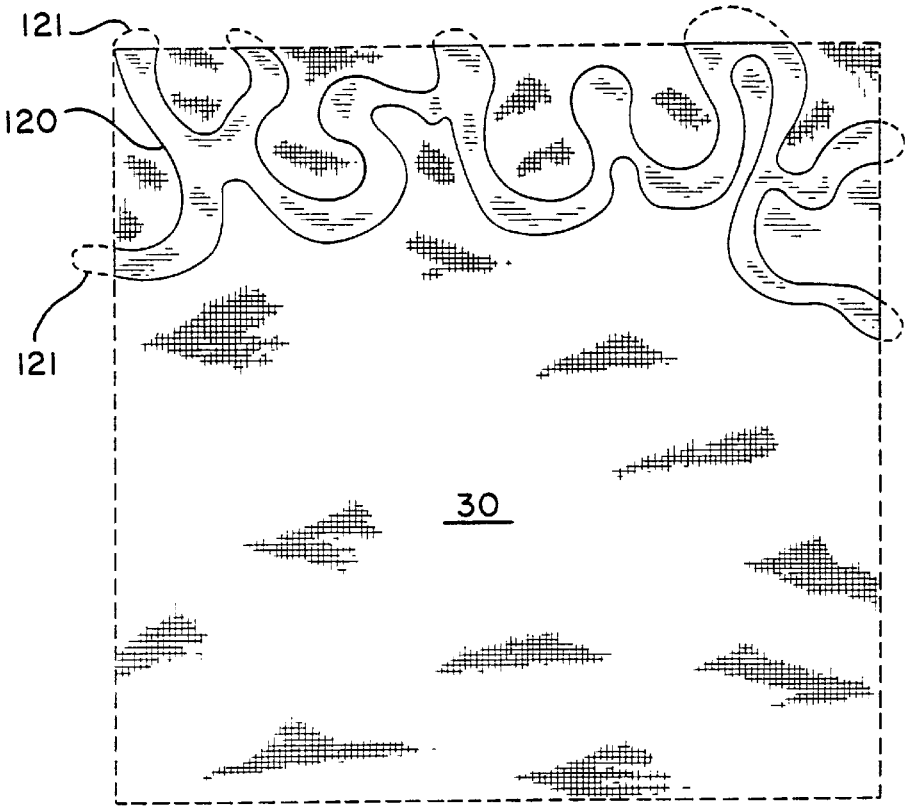
FIG. 8 illustrates a decorative variation of the present invention.

FIG. 8 comprises an alternative embodiment of the decorative strip 40 as illustrated in FIG. 3. However, this embodiment comprises a discontinuous sheet of material in a selectable pattern 120. Pattern 120 is attached, by previously described attachment methods, at either the top or at the sides or both, depending on the design chosen.

In the FIGS. 7 and 8 embodiments, the decorative trim strips do not include the decorative window, wall, or shower enclosure treatment features of the other embodiments.

Figure 9:
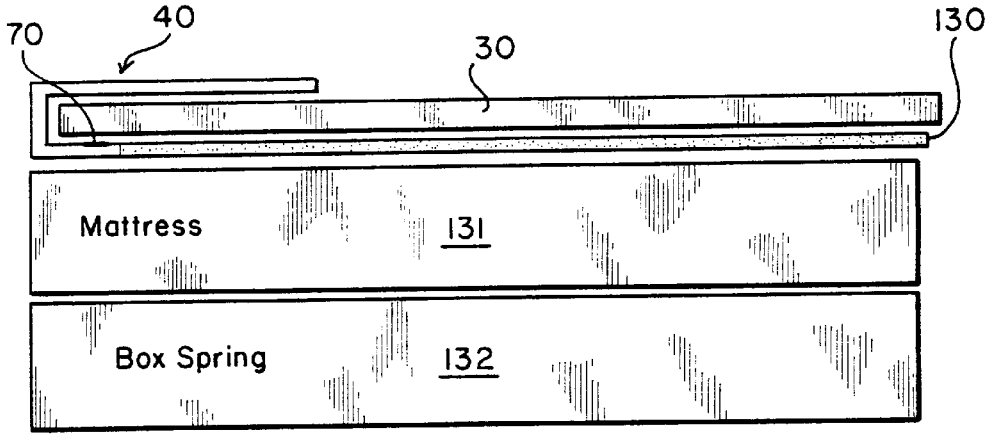
FIG. 9 illustrates a moisture barrier variation of the present invention.

FIG. 9 illustrates a moisture barrier embodiment. Moisture barrier 130 is connected as an extension of decorative trim strip 40. Moisture barrier 130 protects covered bedding as is needed for baby comforters, blankets or other bedding as well as incontinence protection for older children or adults.

In the appended claims, the term "strip" shall cover any piece or body of material or materials whose length is small relative to (e.g. smaller than) its width. Additionally, the manner by which the decorative trim strip 40 is removably attached to the comforter is fully explained in U.S. Pat. No. 5,836,023.

While the preferred embodiments of the invention have been described with certain particularity, various modifications will be envisioned by those skilled in the art. For example, other separable fastener structures (such as, for example, snaps, hook and loop type fasteners, or zippers) may be employed, and the complementary fastener structures may be formed integrally with or by the comforter or decorative trim strip. The comforter and decorative trim strip may be used together with matching pillow shams and dust ruffles to provide a new custom look to an entire room. The second portion of the decorative trim strip may be pleated in a manner similar to conventional window treatment. The decorative edge of the decorative trim strip may be covered with or formed from a lace material, or it may have decorative pointed features or castellations, or random or patterned curves or angles. Tassels, decorative ribbon, bows, or beads may be affixed to or form a part of the decorative edge. The width of the trim strip may be selected to be less than, or substantially equal to, a standard width of a standard comforter (e.g. for a twin, full, queen, or king-sized bed) or any other bed covering for which the decorative trim strip is intended to be used with, or the width of the trim strip may be up to approximately 6" greater than the width of the bed covering. The length of the second portion of the decorative trim strip (i.e. perpendicular to the width) may be selected so as to produce the most aesthetically pleasing design, and the length of the entire trim strip (including the first portion) may be, for example, between about 10" to about 40". A plurality of different decorative trim strips may be selectively coordinated with a single comforter or quilt, and a plurality of similar or different decorative trim strips may be packaged and sold with a single comforter or quilt with or without bed sheets and pillow shams so as to provide decorative treatment alternatives for a bed, room, or building. Therefore, the present invention shall encompass the preferred embodiments described herein as well as any modifications or equivalents thereof which will fall within the scope of the appended claims.

I claim:

1. A bed clothing arrangement, comprising:

a bed covering sized to cover a standard-sized bed, the bed covering having a length, adapted to extend from a head portion to a foot portion of the bed, and a width;

a reversible decorative trim strip made with two or more layers of flexible material, the decorative trim strip having a width and a length, wherein the width of the trim strip is greater than the length of the trim strip, and the length of the trim strip is less than the length of the bed covering, said two or more layers connected substantially along a left and right edge along said length and at a distal edge along said width;

wherein the decorative trim strip is sized and configured in such a manner that, when the decorative trim strip is applied to the bed covering, a first portion is retained beneath said bed covering and a second portion of the decorative trim strip is capable of being extended beyond an edge of the bed covering and manipulated over the edge of the bed covering to thereby overlie a corresponding portion of the top panel of the bed covering.

2. The bed clothing arrangement as recited in claim 1, wherein the bed covering is a comforter.

3. The bed clothing arrangement as recited in claim 1, wherein one or more mating fastener structures are provided on a bottom panel of said bed covering and on the first or second portion of said decorative trim strip.

4. The bed clothing arrangement as recited in claim 3, wherein the first portion of the decorative trim strip comprises one, two or more fabric loops, and wherein said fastening means is formed in one or more of said fabric loops which are adapted to cooperate with said mating fasteners provided for the article of bed clothing.

5. The bed clothing arrangement as recited in claim 4, wherein said one, two or more fabric loops comprises at least two loops separated along the length of said decorative trim strip first section.

6. The bed clothing arrangement as recited in claim 4, wherein said one, two or more fabric loops comprises at least two loops in close proximity and spaced along the length of said decorative trim strip first section.

7. The bed clothing arrangement as recited in claim 4, wherein said one, two or more fabric loops additionally comprise a header section at a distal end of said first section of said decorative trim strip.

8. The bed clothing arrangement as recited in claim 1, wherein the decorative trim strip further comprises one or more appliques attached to said decorative trim strip second section.

9. The bed clothing arrangement as recited in claim 1, wherein the decorative strip comprises one or more decorative edges.

10. The bed clothing arrangement as recited in claim 1, wherein the decorative strip comprises one or more separate layers of decorative flexible materials.

11. The bed clothing arrangement as recited in claim 1, wherein each of said one or more separate layers of decorative flexible materials each is comprised of one or more sublayers.

12. The bed clothing arrangement as recited in claim 11, wherein the decorative strip comprises one or more decorative extensions from a distal edge of said decorative trim strip second section.

13. The bed clothing arrangement as recited in claim 12, wherein the decorative extensions comprise lace.

14. The bed clothing arrangement as recited in claim 12, wherein the two or more layers of flexible material comprise a discontinuous sheet in a pattern configuration.

15. The bed clothing arrangement as recited in claim 1, wherein the decorative strip comprises a moisture barrier extension from a distal edge of said decorative trim strip first section.

16. A bedding arrangement comprising:

a bed covering, the bed covering having a top edge portion;

a decorative trim strip made with one or more flexible material layers, wherein the decorative trim strip has a decorative, non-linearly patterned edge portion which extends in a widthwise direction of the decorative trim strip;

fastening means for fastening the decorative trim strip to said top edge portion of said bed-covering, and wherein said decorative trim strip substantially covers the edge portion of the bed-covering and the decorative, non-linearly patterned edge portion of the decorative trim strip overlies a portion of the top surface of the bed.

17. The bed clothing arrangement as recited in claim 16, wherein the bed covering is a comforter.

18. The bed clothing arrangement as recited in claim 16, wherein the decorative trim strip further comprises one or more appliques attached to said decorative trim strip second section.

19. The bed clothing arrangement as recited in claim 16, wherein the decorative strip comprises one or more decorative edges.

20. The bed clothing arrangement as recited in claim 16, wherein the decorative strip comprises one or more separate layers of decorative flexible materials.

21. The bed clothing arrangement as recited in claim 20, wherein each of said one or more separate layers of decorative flexible materials each is comprised of one or more sublayers.

22. The bed clothing arrangement as recited in claim 16, wherein the decorative strip comprises one or more decorative extension(s) from a distal edge of said decorative trim strip second section.

23. The bed clothing arrangement as recited in claim 22, wherein the decorative extension(s) comprise lace.

24. The bed clothing arrangement as recited in claim 16, wherein the two or more layers of flexible material comprise a discontinuous sheet in a pattern configuration.

25. The bed clothing arrangement as recited in claim 16, wherein the decorative strip additionally comprises a moisture barrier layer.

26. The bedding arrangement as recited in claim 16, wherein the decorative trim strip comprises two or more layers and is reversible upon reversal of said bed covering.

27. A decorative attachment for an article of bed clothing, comprising:

a reversible decorative trim strip made with two or more layers of flexible material, wherein the decorative trim strip comprises a first portion and a second portion, and wherein:

the first portion of the decorative trim strip comprises fastening means, extending in a widthwise direction on the decorative trim strip, for removably fastening the decorative trim strip to the article of bed clothing, and the second portion of the decorative trim strip comprises a decorative, non-linearly patterned edge portion which extends in the widthwise direction of the decorative trim strip.

* * * * *